US007358217B2

(12) United States Patent
Sweet et al.

(10) Patent No.: US 7,358,217 B2
(45) Date of Patent: Apr. 15, 2008

(54) QUENCHING OIL COMPOSITIONS

(75) Inventors: William R. Sweet, Willoughby, OH (US); Sanjay Kalhan, Hudson, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 555 days.

(21) Appl. No.: 10/498,534

(22) PCT Filed: Dec. 16, 2002

(86) PCT No.: PCT/US02/40291

§ 371 (c)(1),
(2), (4) Date: Sep. 20, 2004

(87) PCT Pub. No.: WO03/052146

PCT Pub. Date: Jun. 26, 2003

(65) Prior Publication Data

US 2005/0039832 A1 Feb. 24, 2005

Related U.S. Application Data

(60) Provisional application No. 60/341,632, filed on Dec. 18, 2001.

(51) Int. Cl.
*C10M 129/10* (2006.01)
*C10M 141/02* (2006.01)

(52) U.S. Cl. ..... 508/585; 508/287; 508/390; 508/391; 508/460; 508/465; 508/518; 508/539; 508/551; 508/578; 508/586; 508/591

(58) Field of Classification Search ..... 508/579, 508/585, 586
See application file for complete search history.

(56) References Cited

U.S. PATENT DOCUMENTS

| | | | | |
|---|---|---|---|---|
| 2,340,724 | A | 2/1944 | zur Horst et al. | 148/13.1 |
| 2,599,761 | A | 6/1952 | Harman et al. | 252/49.9 |
| 3,159,510 | A | 12/1964 | Rozalsky et al. | 148/29 |
| 3,489,619 | A | 1/1970 | Brewster | 148/29 |
| 3,498,850 | A | 3/1970 | Morton | 148/18 |
| 3,567,640 | A | 3/1971 | Stroh | 252/59 |
| 3,855,014 | A | 12/1974 | DeVries et al. | 148/28 |
| 5,015,404 | A | 5/1991 | Kubo et al. | 252/49.6 |
| 5,250,122 | A | 10/1993 | Uchida et al. | 148/29 |
| 5,321,172 | A * | 6/1994 | Alexander et al. | 585/2 |
| 5,376,186 | A | 12/1994 | Uchida et al. | 148/29 |
| 5,487,796 | A | 1/1996 | Soraya | 148/633 |
| 5,658,865 | A * | 8/1997 | Yoshida et al. | 508/501 |
| 5,858,932 | A * | 1/1999 | Dasai et al. | 508/371 |
| 5,879,743 | A | 3/1999 | Revankar | 427/191 |
| 6,239,082 | B1 | 5/2001 | Hewson et al. | 508/287 |
| 6,310,009 | B1 | 10/2001 | Kocsis et al. | 508/166 |
| 6,583,092 | B1 * | 6/2003 | Carrick et al. | 508/198 |
| 6,815,401 | B2 * | 11/2004 | Nakamura | 508/192 |
| 6,828,285 | B2 * | 12/2004 | Nakamura | 508/192 |
| 6,872,693 | B2 * | 3/2005 | Cain | 508/185 |
| 6,962,895 | B2 * | 11/2005 | Scharf et al. | 508/185 |

FOREIGN PATENT DOCUMENTS

| | | |
|---|---|---|
| EP | 0113157 A1 | 7/1984 |
| GB | 951139 | 3/1964 |

OTHER PUBLICATIONS

Corresponding International Publication No. WO 03/052146 A1 and Search Report; International Publication Date: Jun. 26, 2003.

* cited by examiner

*Primary Examiner*—Ellen M. McAvoy
(74) *Attorney, Agent, or Firm*—Chritopher D. Hilker; David M. Shold

(57) ABSTRACT

Quenching oil compositions comprising (1) an oil having kinematic viscosity (ASTM Test Method D-445) at 40° C. ranging from about 4 to about 45 mm2sec−1 (about 40 to about 210 Saybolt Universal Seconds (SUS)) and having a saturated content from about 80% to about 100%; and (2) an alkali metal salt of saligenin derivative and optionally, further comprising at least one of (3) an aliphatic polyolefin having Mn ranging from about 300 to about 10,000; (4) at least one member selected from the group consisting of metal salts of hydrocarbyl substituted phenols, salicylic acids, carboxylic acids, and sulfonic acids; and (5) at least one member selected from the group consisting of hydrocarbyl substituted succinic esters, amides, ester-amides, imides, amine salts, acid-esters, acid-amides ester-amine salts, amide-amine-salts and acid-amine salts, and methods of heat treating metals comprising employing said quenching oils.

19 Claims, No Drawings

QUENCHING OIL COMPOSITIONS

This application claims the benefit of U.S. Provisional Application No. 60/341,632 filed Dec. 18, 2001.

FIELD OF THE INVENTION

This invention relates to oil compositions that are useful as quenching oils used in heat treating of metals, particularly ferrous metals such as steel. In particular, this invention is directed to quench oil compositions comprising oil and certain saligenin derivatives.

BACKGROUND OF THE INVENTION

Desired hardness and strength properties of metals, particularly ferrous metals and especially metal alloys such as carbon steel and alloy steel, are secured by heat treatment of the metal object. The properties usually depend upon establishment of certain physical structures in the metal. The production of the desired physical structures is obtained by heating the metal to a temperature where the structure is present, then by arresting at the desired point the changes in the internal structure which take place during cooling of the metal from high temperatures. Quick cooling by quenching the heated object in a quenching medium makes it possible to arrest the physical changes at the desired point during cooling.

Quenching in the quenching medium is carried out in such a manner that the physical changes in the metal are arrested at the desired point, usually at the point at which maximum hardness is obtained. Subsequently, the heat treated and quenched object may be subjected to treatment at lower temperature (annealing or tempering) to provide the desired degree of toughness and ductility.

For many years mineral oil based quenching fluids have been used. Previously, aqueous quenching media were employed. The aqueous fluids provided extremely rapid cooling setting up excessive amounts of internal stress in the object. Mineral oil based fluids avoided this difficulty, but often did not provide a sufficiently high cooling rate to secure desirable properties in pieces formed of materials having high critical cooling rates to develop maximum strength and hardness or to quench pieces of high mass to surface ratios to develop hardness and strength to maximum depth.

It is also desirable to provide quench oils that possess sufficient durability, cleanliness and consistency. Durability refers to additive lifetime after being exposed to thermal stressing while consistency relates to constant additive performance over time. Cleanliness relates to amounts of deposits on the workpiece and/or staining thereof and is measured using a coker test.

A detailed description of heat treating of steel appears at pages 961 et seq of the *Metals Handbook*, Desk Edition, Second Edition, J. R. Davis, Ed., ASM International, Metals Park, Ohio, USA (1998). A discussion of quenching appears at pages 973-975 of that text.

U.S. Pat. No. 2,340,724 relates to quenching oils comprising a light mineral quenching oil and an oil-soluble, heat stable, high molecular weight iso-olefin polymerization product in a controlled amount adequate to produce a quenching oil composition having an initial 5-second quenching speed of at least 22.0 percent without substantially modifying the stress-reducing characteristics of the oil. Polymers of molecular weigh 1,000 to 10,000, and particularly, isobutylene polymerization product, are said to be particularly advantageous.

U.S. Pat. No. 3,489,619 relates to oil compositions described as having good high temperature stability and useful as a heat transfer oil for the quenching of metals. The oil comprises a major proportion of a hydrocarbon lubricating oil into which has been dispersed a minor proportion of an alkali metal phosphate, silicate or borate with the aid of a minor proportion of a high molecular weight monocarboxylic acid, dicarboxylic acid or dicarboxylic acid anhydride.

U.S. Pat. No. 3,567,640 describes a quenching oil composition comprised of a major portion of a petroleum oil having a viscosity within the range of about 40 to about 300 SUS at 100° F. and a flash point in excess of 250° F. and about 2% to about 15% by weight of a quench oil additive, which is an oil soluble petroleum resin produced from distillates of cracked petroleum stock having a melting point of at least 40° C. and an aniline point value of less than 50° C.

U.S. Pat. No. 3,855,014 describes an improved quenching oil composition comprising a major amount of a quench oil of lubricating viscosity; a minor amount of at least one carbon-linked poly-phenate metal compound sufficient to improve the anti-staining properties of the composition and at least one naphthyl amine sufficient to improve the resistance to oxidation of the composition. The composition may also include a minor amount of at least one of certain diamine components said to provide further improved oxidation resistance.

U.S. Pat. No. 5,015,404 describes an oil composition containing 100 parts by weight of a base oil selected from the group consisting of mineral base oil, synthetic base oil and mixtures thereof, and 0.1 to 20 parts by weight of a hydrogenated oil obtained by hydrogenating an oil selected from the group consisting of coal type tar, oil produced by fractionating coal type tar, a hydrocarbon obtained by thermally cracking petroleum and having a boiling point of not lower than 200° C., a hydrocarbon obtained by catalytically cracking petroleum and having a boiling point of not lower than 200° C., a hydrocarbon obtained by catalytically reforming petroleum and having a boiling point of not lower than 200° C., and mixtures thereof, whereby the hydrogenated oil has the hydrogen-donating properties of not lower than three times the hydrogen-donating properties of the base oil at temperatures of not lower than 350° C.

U.S. Pat. No. 5,250,122 discloses a heat treating oil composition which comprises (A) at least one base oil selected from a mineral oil and a synthetic oil each having a sulfur content of not more than 300 ppm and (C) at least one member selected from alkaline earth metal salts of salicylic acid. There is also disclosed a heat treating oil composition which comprises (I) a base oil having a sulfur content of 3 to 1000 ppm consisting of said (A) component and (C) at lease one member selected from a sulfur and a sulfur compound, along with (II) various additives for quenching. This heat treating oil composition is said to be suitable for quenching under the condition of a high oil temperature and capable of obtaining a treated metal excellent in brightness and having a minimized distortion.

U.S. Pat. No. 5,376,186 describes a heat treating oil composition which comprises a base oil adjusted to have a total sulfur content of 3 to 1000 ppm comprising (A) at least one base oil selected from a mineral oil and a synthetic oil each having a sulfur content of not more than 300 ppm and (C) at least one member selected from a sulfur and a sulfur compound, and (B) at least one additive selected from an alkaline earth metal salt of sulfonic acid, that of a phenol, alkenyl succinic acid derivatives, fatty acid or its derivatives and phenol-based and amine-based antioxidants. The above-mentioned heat treating oil composition is said to be suitable for quenching under a condition of a high oil temperature to realize a treated metal product having a excellent brightness and little distortion.

U.S. Pat. No. 5,487,796 relates to a method of quenching metals, in particular steel alloys includes treatment of the article being quenched in a boiling aqueous solution of sodium tetraborate, with gas being additionally introduced into the quench bath. The supply of gas enables a continuous operation in a wide range of application and avoids the use of conventional less environmentally friendly quenching media (oils).

U.S. Pat. No. 5,879,743 describes a wear-resistant hardfacing and a method for applying such a hardfacing. A finely powdered, wear-resistant alloy and a polyvinyl alcohol (PVA) solution slurry is coated onto the metal surface of a tool, implement, or similar item to be hardfaced. Alternatively, a binding coating of PVA solution may be applied to the metal surface followed by application of a layer of a powdered alloy. After the slurry or PVA binding coating has dried, leaving a dry coat of alloy in a PVA matrix, the metal surface is heated to the fusion temperature of the alloy in vacuum, in an inert gas atmosphere, or in hydrogen atmosphere. The metal item with the fused coating is heat treated to impart desired mechanical properties to the part substrate material. The method of the present invention gives a smooth, dense coating of the wear-resistant hardfacing without nonmetallic inclusions.

U.S. Pat. No. 6,239,082 describes petroleum quench oils described as effective for high speed cooling of heated metals and metal hardening. The petroleum quench oils contain natural or synthetic base oils having a minimum flash point of about 120° C. and a combination of poly(iso)alkylene and poly(iso)alkylene succinic anhydride or succinic acid. A method for cooling heated metal to harden it, improve the metallurgical consistency, improve machinability and reduce residue on quenched metal parts is also disclosed comprising quenching the heated metal part in a quench oil containing natural or synthetic base oils having a minimum flash point of about 120° C. and a combination of poly(iso)alkylene and poly(iso)alkylene succinic anhydride or succinic acid.

Copending, commonly assigned patent application Docket No. 3097R is directed to a quenching oil composition comprising (1) an oil having kinematic viscosity (ASTM Test Method D-445) at 40° C. ranging from about 4 to about 45 $mm^2sec^{-1}$ (about 40 to about 210 Saybolt Universal Seconds (SUS)) and having a saturated content from about 80% to about 100%; (2) an aliphatic polyolefin having $\overline{M}_n$ ranging from about 300 to about 10,000; and (3) at least one member selected from members of the groups consisting of (a) a metal salt of hydrocarbyl substituted phenols, salicylic acids, carboxylic acids, and sulfonic acids; and optionally, at least one member selected from members of the groups consisting of (b) hydrocarbyl substituted succinic esters, amides, ester-amides, imides, amine salts, acid-esters, acid-amides ester-amine salts, amide-amine-salts and acid-amine salts.

The quench oils of the instant invention afford durability, consistency and suitable quenching characteristics. Suitable quenching characteristics include a high maximum cooling rate and a high maximum cooling rate temperature signifying collapse of the vapor barrier between the workpiece and the quenching oil, and a lower cooling rate (6-8° C.) after the workpiece has reached 300° C. to prevent thermal distortion/cracking.

SUMMARY OF THE INVENTION

The instant invention is directed to a quenching oil composition comprising (1) an oil having kinematic viscosity (ASTM Test Method D-445) at 40° C. ranging from about 4 to about 45 $mm^2sec^{-1}$ (about 40 to about 210 Saybolt Universal Seconds (SUS)) and having a saturated content from about 80% to about 100%; and (2) an alkali metal salt of a saligenin derivative, represented by the formula

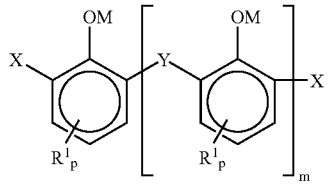

where M is an alkali metal, and the identity, description, and other symbols are as described below.

In an optional embodiment, the quench oils of this invention further comprise at least one of (3) an aliphatic polyolefin having $\overline{M}_n$ ranging from about 300 to about 10,000; and (4) at least one member selected from the group consisting of metal salts of hydrocarbyl substituted phenols, salicylic acids, carboxylic acids, and sulfonic acids and alkaline earth metal salts of hydrocarbyl substituted saliginen derivatives; and (5) at least one member selected from the group consisting of hydrocarbyl substituted succinic esters, amides, ester-amides, imides, amine salts, acid-esters, acid-amides ester-amine salts, amide-amine-salts and acid-amine salts.

DETAILED DESCRIPTION OF THE PREFERRED EMBODIMENTS

As used herein, the terms "hydrocarbyl" or "hydrocarbon based" mean that the group being described has predominantly hydrocarbon character within the context of this invention. These include groups that are purely hydrocarbon in nature, that is, they contain only carbon and hydrogen. They may also include groups containing substituents or atoms which do not alter the predominantly hydrocarbon character of the group. Such substituents may include halo-, alkoxy-, nitro-, hydroxyl, etc. These groups also may contain heteroatoms. Suitable heteroatoms will be apparent to those skilled in the art and include, for example, sulfur, nitrogen and oxygen. Therefore, while remaining predominantly hydrocarbon in character within the context of this invention, these groups may contain atoms other than carbon present in a chain or ring otherwise composed of carbon atoms.

In general, no more than about three non-hydrocarbon substituents or heteroatoms, and preferably no more than one, will be present for every 10 carbon atoms in the hydrocarbon or hydrocarbon based groups. Most preferably, the groups are purely hydrocarbon in nature, that is, they are essentially free of atoms other than carbon and hydrogen.

It must be noted that as used in this specification and in the appended claims, the singular forms also include the plural unless the context clearly dictates otherwise. Thus the singular forms "a", "an", and "the" include the plural; for example "an amine" includes mixtures of amines of the same type. As another example the singular form "amine" is intended to include both singular and plural unless the context clearly indicates otherwise.

The Oil

The quenching oil compositions of this invention comprise at least one oil having kinematic viscosity (ASTM Test Method D-445) at 40° C. ranging from about 4 to about 45 $mm^2sec^{-1}$ (40 to about 210 SUS) and having a saturated content from about 80% to about 100%. Both mineral oils and synthetic oils are useful. Mixtures of these oils are useful. In one preferred embodiment, the oil is a paraffinic mineral oil, particularly a solvent refined paraffinic oil. In another preferred embodiment, the oil is a hydrotreated mineral oil having kinematic viscosity of from about 10 to about 18 $mm^2sec^{-1}$ (about 60 to about 90 SUS). In yet another preferred embodiment, the oil is a poly-alphaolefin oligomer, preferably a polyoctene or polydecene oligomer.

Examples of useful oils include Excel/Paralube 70N, Excel/Paralube 75HC, (both from Pennzoil/Conoco) and Ergon® Hygold P70N.

(2) The Alkali Metal Salt of Saligenin Derivatives

The quenching oil compositions of this invention contain at least one member selected from the group consisting of alkali metal salts of hydrocarbyl substituted saligenin derivatives. The metal salts may be acidic or neutral. The quenching oil compositions usually contain alkali metal salts in amounts ranging from about 0.05% to about 4% by weight, more often from about 0.1% to about 2% by weight based on the total weight of the quenching oil composition.

The relative amount of metal present in metal salts is frequently indicated by the expression "metal ratio" (abbreviated MR), which is defined as the number of equivalents of metal present compared to a "normal", stoichiometric amount. Thus, for example, an acidic salt contains less than the stoichiometric amount of metal and has a metal ratio (MR) <1. Neutral salts, i.e., those containing substantially stoichiometric amounts of metal, have metal ratios of about 1. For the purposes of this invention, the metal ratio of alkali metal salts of hydrocarbyl substituted saligenin derivatives ranges from about 0.5 to about 5, preferably from about 0.5 to about 2.

The basicity of the metal salts used in the present invention generally is expressed in terms of a total base number TBN). TBN is the amount of acid (perchloric or hydrochloric) needed to neutralize all of the metal salt's basicity. The amount of acid is expressed as potassium hydroxide equivalents. Total base number is determined by the procedure described in ASTM D-2896. Typically, the metal salt has TBN ranging from about 45 to about 900, preferably from about 100 to about 400.

Saligenin, also known as salicyl alcohol and o-hydroxybenzyl alcohol, is represented by the structure

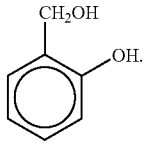

The alkali metal salts of saligenin derivatives of the present invention can be represented by the formula

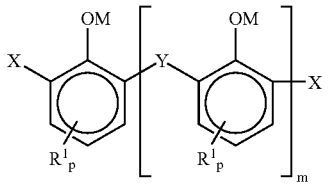

where M is an alkali metal, and the identity, description, and amounts of other symbols are as set forth hereinbelow. Alkali metals are those of Group 1 of the Periodic Table of Elements as presented in CRC Handbook of Chemistry and Physics, 73rd Ed., David R. Lide, Editor-in-Chief, CRC Press, Boca Raton, Fla., USA (1992-1993) and especially lithium, sodium, and potassium The metal salt may contain one or more alkali metals.

The compound contains one aromatic ring or a multiplicity of aromatic rings linked by "Y" groups, and also "X" groups. Thus, "m" can be 0 to 10. This means that the number of such rings can be 1 to 11, although it is to be understood that the upper limit of "m" is not a critical variable. Preferably, m is 2 to 9, more preferably 3 to 6.

At least one ring, and preferably most of the rings contain at least one $R^1$ substituent, which is a hydrocarbyl group, preferably an alkyl group, containing 1 to 60 carbon atoms, more preferably 7 to 18 carbon atoms. The $R^1$ groups will normally comprise a mixture of various chain lengths, so that the foregoing numbers usually represent an average number of carbon atoms in the $R^1$ groups (number average). Each ring in the structure will be substituted with 0, 1, 2, or 3 such $R^1$ groups (that is, each p is independently 0, 1, 2, or 3, most typically 1, and different rings in a given molecule may contain different numbers of such substituents. At least one aromatic ring in the molecule must contain at least one $R^1$ group, and the total number of carbon atoms in all the $R^1$ groups in the molecule should be at least 7, preferably at least 12.

In the above structure the X and Y groups may be seen as groups derived from formaldehyde or a formaldehyde source, by condensative reaction with the aromatic molecule. While various species of X and Y may be present in the molecules in question, the commonest species comprising X are CHO (aldehyde functionality) and $CH_2OH$ (hydroxymethyl functionality); similarly the commonest species comprising Y are $CH_2$ (methylene bridge) and $CH_2OCH_2$ (ether bridge). The relative molar amounts of these species in a sample of the above material can be determined by $^1H/^{13}C$ NMR as each carbon and hydrogen nucleus has a distinctive environment and produces a distinctive signal. The signal for the ether linkage, —$CH_2OCH_2$— must be corrected for the presence of two carbon atoms, in order to arrive at a correct calculation of the molar amount of this material. Such a correction is well within the abilities of the person skilled in the art.

X is at least in part $CH_2OH$ and such $CH_2OH$ groups comprise 5 to 50 mole percent of the X and Y groups, preferably 10 to 30 mole percent of the X and Y groups.

If m is 1 or greater, then one of the X groups can be —H.

In a preferred embodiment, X is in part CHO and such CHO groups comprise at least 1, and up to about 40 mole percent of the X and Y groups. Preferably the CHO groups comprise from about 1 to about 20 mole percent of the X and Y groups and more preferably from about 1 to about 10 mole percent of the X and Y groups.

In an embodiment in which m is non-zero, Y is at least in part $CH_2$ and such $CH_2$ groups comprise from about 25 to about 80 mole percent of the X and Y groups, preferably from about 35 to about 75 mole percent of the X and Y groups.

In another embodiment Y is at least in part $CH_2OCH_2$ and such $CH_2OCH_2$ groups comprise from about 5 to about 30 mole percent of the X and Y groups, and preferably from about 10 to about 25 mole percent of the X and Y groups.

The relative amounts of the various X and Y groups depends to a certain extent on the conditions of synthesis of the molecules. Under many conditions the amount of $CH_2OCH_2$ groups is relatively small compared to the other groups and is reasonably constant at about 10 to about 15 mole percent.

The acidic organic compounds useful in making the metal salts of the present invention comprise hydrocarbyl substituted saligenin derivatives, that is hydrocarbyl substituted 2-hydroxybenzyl alcohol derivatives.

The following examples illustrate several alkali metal salts of saligenin derivatives used in preparation of the quenching oil compositions of this invention. These examples are intended to be illustrative only and are not intended to limit the scope of the invention. Unless indicated otherwise, all parts are parts by weight and temperatures are in degrees Celsius. All analytical values are by analysis. Filtrations employ a diatomaceous earth filter aid.

EXAMPLE 1

A reactor equipped with a stirrer, thermowell, and cold water condenser is charged with 335 parts mineral oil, 500 parts para-dodecyl phenol and 2.5 parts tap water. The materials are heated, with stirring, to 35° C. followed by the rapid addition of 126 parts 91% paraformaldehyde then 4 parts NaOH and 51 parts mineral oil. The mixture is heated to 79° C. and is held at temperature for 1 hour. The materials are cooled to 60° C. followed by addition of 56 parts NaOH. The materials are heated to 100° C., are held at temperature for 1 hour followed by addition of 126 parts mineral oil. The materials are stripped for 0.5 hour at 120° C. under reduced pressure, then filtered. The filtrate contains 2.42% Na, 7.73% $SO_4$ ash and has TBN 57.

EXAMPLE 2

The procedure of Example 1 is repeated except 10 parts water are used and NaOH is replaced with 64 parts $LiOH.H_2O$ which is added in 2.8 part and 61.2 part increments. Vacuum stripping is at 20 mm Hg pressure. The filtrate contains 0.9% Li, 7.05% $Li_2SO_4$ ash and has TBN 74.

EXAMPLE 3

The procedure of Example 2 is repeated replacing $LiOH.H_2O$ with 84 parts KOH which is added in 7 part and 77 part increments. The filtrate contains 3.3% K and 7.3% $K_2SO_4$ ash and has TBN 45.

As noted hereinabove, the quenching oil compositions of this invention may further comprise at least one of (3) an aliphatic polyolefin having $\overline{M}_n$ ranging from about 300 to about 10,000;

(4) at least one member selected from the group consisting of metal salts of hydrocarbyl substituted phenols, salicylic acids, carboxylic acids, and sulfonic acids; and alkaline earth metal salts of hydrocarbyl substituted saligenin derivatives; and (5) at least one member selected from the group consisting of hydrocarbyl substituted succinic esters, amides, ester-amides, imides, amine salts, acid-esters, acid-amides ester-amine salts, amide-amine-salts and acid-amine salts.

The Polyolefin

The quenching oil compositions of this invention may further comprise (3) a polyolefin having $\overline{M}_n$ ranging from about 300 to about 10,000, preferably from about 500 to about 5,000 and more often from about 1,000 to about 3,000 and often ranging from about 1,500 to about 3,000.

In one preferred embodiment, the polyolefin is an aliphatic polyolefin derived from at least one alpha olefin containing from 3 to about 8 carbon atoms. Polyolefins derived from more than one olefin, for example ethylene-propylene copolymers, are useful. Polypropylene and polybutenes, especially polyisobutylene, are preferred. Polyisobutylene is particularly preferred.

In another preferred embodiment, the polyolefin is an olefin-polyene, preferably diene, especially preferred non-conjugated diene, copolymer, derived from at least one olefin, preferably an alpha olefin containing from about 3 to about 8 carbon atoms and the ratio of total number of moles of olefin to moles of polyene ranges from about 100:1 to about 1:1, preferably 25:1 to 1:2 and most preferably, 15:1 to 1:1. In a preferred embodiment, the olefin is isobutylene. Useful polymers of this type are commercially available, for example from BASF and BP Chemicals.

In one embodiment, the polyolefin is an olefin-diene copolymer comprising from about 0.5 to about 5 moles of units derived from diene per mole of copolymer based on $\overline{M}_n$ of copolymer. In another embodiment, the polyolefin is an olefin-polyene copolymer, wherein the olefin contains from 3 to about 8 carbon atoms and weight ratio of olefin to polyene ranges from about 250:1 to about 1:4, preferably 25:1 to 1:2 and most preferably 15:1 to 1:1. In each of these embodiments, the olefin comprises isobutylene. Examples of olefin-diene copolymers include butyl rubbers (isobutylene-isoprene) and commercially available ethylene-propylene-diene terpolymers sold by Uniroyal Chemicals under the tradename TRILENE®.

The Additional Metal Salt

The quenching oil compositions of this invention may further comprise (4) at least one additional metal salt, a member selected from the group consisting of metal salts of hydrocarbyl substituted phenols, salicylic acids, carboxylic acids, and sulfonic acids. The additional metal salt may also be an alkaline earth metal salt of a saliginen derivative. The metal salts may be acidic, neutral or basic, often referred to as 'overbased'. For the purposes of this invention, the metal ratio of metal salts of phenols and salicylic acids and alkaline earth metal saliginen derivatives ranges from about 0.5 to about 5, preferably from about 0.5 to about 2 and the metal ratio of metal salts of sulfonic acids ranges from about 1 to about 20, preferably from about 1 to about 3

The basicity of the additional metal salts used in the present invention generally is expressed in terms of a total base number TBN as defined hereinabove. Typically, the metal salt has TBN ranging from about 45 to about 900, preferably from about 100 to about 800.

The additional metal salts and techniques for preparing them are well known to those skilled in the art. Neutral and acidic salts are generally prepared by contacting the acidic reactant with a metal reactant to form the salt. Overbased materials are prepared by reacting an acidic material (typically an inorganic acid or lower carboxylic acid, preferably carbon dioxide) with a mixture comprising an acidic organic compound, a reaction medium comprising at least one inert, organic solvent for said acidic organic material, a stoichiometric excess of a metal base, and a promoter.

The acidic organic compounds useful in making the additional metal salts include carboxylic acids, sulfonic acids, phenols or mixtures of two or more thereof.

Salicylic acids are considered as both phenols and carboxylic acids. Salicylic acids can be aliphatic hydrocarbon-substituted salicylic acids wherein each aliphatic hydrocarbon substituent contains an average of at least about 8 carbon atoms per substituent.

Sulfonic acids useful in the invention include the sulfonic and thiosulfonic acids. The sulfonic acids include the mono- or polynuclear aromatic or cycloaliphatic compounds. Illustrative examples of sulfonic acids include hydrocarbyl substituted naphthalene sulfonic acids, hydrocarbyl substituted benzene sulfonic acids, petroleum sulfonic acid and the like.

Phenols useful in making the metal salts used in this the invention can be represented by the formula $(R_1)_a$—Ar—$(OH)_b$, wherein $R_1$ is a hydrocarbon group; Ar is an aromatic group; a and b are independently numbers of at least one, the sum of a and b being in the range of two up to the number of displaceable hydrogens on the aromatic nucleus or nuclei of Ar.

While the term "phenol" is used herein, it is to be understood that this term refers to both mononuclear and polynuclear aromatic compounds. Polynuclear groups can be of the fused type wherein an aromatic nucleus is fused at two points to another nucleus or of the linked type wherein at least two nuclei (either mononuclear or polynuclear aromatic) are linked through bridging linkages to each other.

Saligenin derivatives are similar to those described herein with the proviso that the distribution of X and Y groups is modified as set forth in U.S. Pat. No. 6,310,009.

The metal compounds useful in making the basic metal salts are generally any Group 1, Group 2, Group 11 or Group 12 metal compounds (see aforementioned Periodic Table of Elements as presented in CRC Handbook of Chemistry and Physics, 73rd Ed). Group 1 metals are alkali metals (sodium, potassium, lithium, etc.). Group 2 metals are the alkaline earth metals (magnesium, calcium, barium, etc.). Group 11 metals include, for example, copper and Group 12 metals include zinc cadmium.

An acidic material is used to accomplish the formation of the basic metal salt. A promoter is a chemical employed to facilitate the incorporation of metal into the basic metal compositions. A particularly comprehensive discussion of suitable promoters is found in U.S. Pat. Nos. 2,777,874, 2,695,910, and 2,616,904.

The metal of the additional metal salt preferably comprises at least one of alkali and/or alkaline earth metal. In one preferred embodiment, the additional metal salt is an alkaline earth metal salt. As noted hereinabove, when the additional metal salt is one of a saliginen derivative, the metal is an alkaline earth metal.

In one embodiment, the additional metal salt comprises a metal salt of sulfur or methylene coupled hydrocarbyl substituted phenols or salicylic acids. In one embodiment, the additional metal salt comprises a metal salt of a hydrocarbyl substituted phenol. In another embodiment, the additional metal salt comprises the Mg or Ca methylene coupled $C_{7-15}$ aliphatic group substituted phenate and in another embodiment, an alkaline earth metal salt of a hydrocarbyl substituted saligenin derivative.

In one preferred embodiment, the additional metal salt comprises a metal salt of a hydrocarbyl substituted salicylic acid, in another embodiment, a metal salt of a hydrocarbyl substituted sulfonic acid and in yet another embodiment, a metal salt of a hydrocarbyl substituted carboxylic acid.

Mixtures of two or more of these additional metal salts may be used.

Hydrocarbyl Substituted Succinic Derivatives

The quenching oil compositions of this invention may further comprise (5) hydrocarbyl substituted succinic derivatives selected from the group consisting of esters, amides, ester-amides, imides, amine salts, acid-esters, acid-amides ester-amine salts, amide-amine-salts and acid-amine salts. The hydrocarbyl substituent typically has $\overline{M}_n$ ranging from about 500 to about 5000, preferably from about 900 to about 2500.

These succinic derivatives are well-known to those skilled in the art.

When one or more of these optional ingredients is present in the quenching oil compositions of this invention, they typically comprise from about 0.2% to about 10%, preferably from about 0.2% to about 5% by weight of the aliphatic polyolefin (3), and/or a total of from 0.2% to about 10%, often to about 5% by weight of a metal salt of hydrocarbyl substituted phenols, salicylic acids and sulfonic acids, and/or from about 0.1% to about 5%, often to about 4% by weight of at least one of hydrocarbyl substituted succinic esters, amides, ester-amides, imides, amine salts, acid-esters, acid-amides, ester-amine salts, amide-amine salts and acid-amine salts.

In one embodiment, the composition may comprise, in addition to the oil and the alkali metal salt of a saliginen derivative, from about 0.2% to about 5% by weight of the aliphatic polyolefin (3), and from about 0.2% to about 5% by weight of (4) at least one metal salt of hydrocarbyl substituted phenols, salicylic acids and sulfonic acids wherein the weight ratio of (3):(4) ranges from about 10:1 to about 1:10.

In another embodiment, the composition may comprise, in addition to the oil and the alkali metal salt of a saliginen derivative, from about 0.2% to about 5% by weight of the aliphatic polyolefin (3), a total of from about 0.2% to about 4% by weight of (4) at least one additional metal salt selected from the group consisting of hydrocarbyl substituted phenols, salicylic acids and sulfonic acids; and a total of from about 0.1% to about 4% by weight of (5) at least one hydrocarbyl substituted succinic derivative selected from the group consisting of amides, imides, amine salts, acid-amides and acid-amine salts wherein the weight ratio of polyolefin:metal salt:succinic derivative ranges from about (20-40):(40-70):(10-20).

This invention also relates to a method of heat treating metals comprising heating the metal to a temperature above its critical temperature and thereafter cooling the metal by immersion thereof into a quenching oil bath comprising the quenching oil composition of this invention.

The additive components may be incorporated into the base oil as individual components, added thereto in any order. Alternatively, the additive components are added to the base oil as a concentrate which comprises the desired additives in appropriate ratios which, when incorporated into the base oil, provide a finished quenching oil composition containing the desired amount of each additive.

The following examples illustrate additive concentrates uses to prepare quenching oil compositions of this invention. All parts are parts by weight and unless indicated otherwise, are on a neat chemical, i.e., oil and diluent free, basis.

TABLE 1

| | Example # | | | | | |
|---|---|---|---|---|---|---|
| | A | B | C | D | E | F |
| | Parts by Weight | | | | | |
| Product of Example 1 | | 10 | | | | |
| Product of Example 2 | | | 10 | 10 | 10 | 10 |
| Product of Example 3 | 50 | | | | | |
| Polyisobutylene ($\overline{M}_n$~1700) | 25 | 25 | 30 | 30 | 30 | 30 |
| Ca (MR 0.85) Me $C_{12}$-Phenol (55% oil) | | | 60 | | 50 | |
| Mg (MR 0.8) Me $C_{12}$-Saligenin (50% oil) | | 50 | | 60 | | 50 |
| Polyisobutenyl ($\overline{M}_n$~1700) Succinimide (55% Oil) | 25 | 15 | | | 10 | 10 |

Me: methylene coupled

The examples in the following tables illustrate quenching oil compositions of this invention. All parts are parts by weight. Amounts of compositions of the examples (alkali metal salts of saligenin derivatives and of additive concentrates) are used on an 'as prepared' basis, including any diluents, if present.

TABLE 2

| Excel/Paralube 70 N+ | | | | |
|---|---|---|---|---|
| | Example #: | | | |
| Product of Example | I | II | III | IV |
| | Parts by Weight | | | |
| 2 | 2 | 4 | | |
| 3 | | | 2 | 4 |

TABLE 3

| Excel/Paralube 75-HC + | | | | | | | |
|---|---|---|---|---|---|---|---|
| | Example #: | | | | | | |
| Product of Example | V | VI | VII | VIII | IX | X | XI |
| | Parts by Weight | | | | | | |
| 1 | 2 | | | | | | |
| 2 | | 2 | | | | | |
| 3 | | | 2 | | | | |
| A | | | | 2 | 4 | 6 | |
| B | | | | | | | 2 |

TABLE 4

| Ergon Hygold P70N + | | | | | | | | |
|---|---|---|---|---|---|---|---|---|
| | Example #: | | | | | | | |
| Product of Example | XII | XIII | XIV | XV | XVI | XVII | XVIII | XIX |
| | Parts by Weight | | | | | | | |
| C | 2 | 4 | | | | | | |
| D | | | 2 | 4 | | | | |
| E | | | | | 2 | 4 | | |
| F | | | | | | | 2 | 4 |

A portion of each of these oils as well as commercial quench oils is heat stressed by heating at 170° C. for 22 hours while aerating at 10 liters per hour and tested with respect to the non-stressed quench oil samples.

Each sample is subjected to a one-minute quench test and a 3 hour panel coker test. The quench test quantifies the cooling characteristics of the quench oil sample and the panel coker test measures the tendency of the quench oil sample to stain and/or form deposits on hot metal surfaces. Similar results between corresponding heat stressed and unstressed oils samples provide an indication of durability and consistency of the test oils.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

Except in the examples, or where otherwise explicitly indicated, all numerical quantities in this description specifying amounts of materials, reaction conditions, molecular weights, number of carbon atoms, and the like, are to be understood as modified by the word "about". Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil that may be customarily present in the commercial material, unless otherwise indicated. It is to be understood that the upper and lower amount, range, and ratio limits set forth herein may be independently combined. As used herein, the expression "consisting essentially of" permits the inclusion of substances that do not materially affect the basic and novel characteristics of the composition under consideration.

While the invention has been explained in relation to its preferred embodiments, it is to be understood that various modifications thereof will become apparent to those skilled in the art upon reading the specification. Therefore, it is to be understood that the invention disclosed herein is intended to cover such modifications that fall within the scope of the appended claims.

What is claimed is:

1. A quenching oil composition comprising (1) an oil having kinematic viscosity at 40° C. ranging from about 4 to about 45 $mm^2sec^{-1}$ and having a saturated content from about 80% to about 100%; and (2) an alkali metal salt of a saligenin derivative represented by the formula where each M is, independently, an alkali metal, each $R^1$ is a hydrocarbyl group

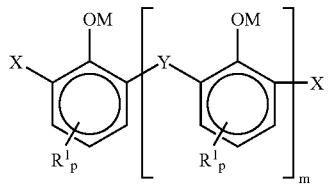

containing 1 to 60 carbon atoms, each p is a number ranging from 0 to 3 with the proviso that at least one p is at least 1, each X is, independently, H, CHO or $CH_2OH$, provided that at least one X is $CH_2OH$, each Y is, independently, $CH_2$ or $CH_2OCH_2$ and m ranges from 0 to about 10.

2. The composition of claim 1 further comprising at least one of (3) an aliphatic polyolefin having $\overline{M}_n$ ranging from about 300 to about 10,000;

(4) a member selected from the group consisting of metal salts of hydrocarbyl substituted phenols, salicylic acids, carboxylic acids, and sulfonic acids, and alkaline earth metal salts of saligenin derivatives; and (5) a member selected from the group consisting of hydrocarbyl substituted succinic derivatives selected from the group consisting of esters, amides, ester-amides, imides, amine salts, acid-esters, acid-amides ester-amine salts, amide-amine-salts and acid-amine salts.

3. The composition of claim 1 wherein (1) the oil is a mineral oil and/or synthetic oil.

4. The composition of claim 3 wherein the mineral oil is a hydrotreated oil having kinematic viscosity of about 60 to about 90 SUS.

5. The composition of claim 4 wherein the synthetic oil is a poly-alphaolefin oligomer.

6. The composition of claim 1 wherein (1) the oil is a mixture of mineral oil and synthetic oil.

7. The composition of claim 1 wherein the alkali metal salt (2) is selected from the group consisting of lithium, sodium and potassium salts.

8. The composition of claim 2 comprising (3) the polyolefin wherein said polyolefin is derived from at least one alpha olefin containing from 3 to about 8 carbon atoms.

9. The composition of claim 8 wherein the polyolefin is polyisobutylene.

10. The composition of claim 2 comprising (3) the polyolefin wherein said polyolefin is an olefin-polyene copolymer, wherein the olefin contains from about 3 to about 8 carbon atoms and the ratio of moles of olefin to moles of polyene ranges from about 100:1 to about 1:1.

11. The composition of claim 2 comprising (3) the polyolefin wherein said polyolefin is an olefin-polyene copolymer, wherein the olefin contains from 3 to about 8 carbon atoms and weight ratio of olefin to polyene ranges from about 250:1 to about 1:4.

12. The composition of claim 10 wherein said polyolefin is an isobutylene-diene copolymer comprising from about 0.5 to about 5 moles of units derived from diene per mole of copolymer based on $\overline{M}_n$ of copolymer.

13. The composition of claim 8 wherein the polyolefin has $\overline{M}_n$ ranging from about 500 to about 5,000.

14. The composition of claim 2 comprising at least one member selected from the group consisting of (4) a metal salt of hydrocarbyl substituted phenols, salicylic acids, carboxylic acids, and sulfonic acids.

15. The composition of claim 14 wherein (4) comprises a metal salt of sulfur or methylene coupled hydrocarbyl substituted phenols or salicylic acids.

16. The composition of claim 14 wherein the metal salt (4) has TBN ranging from about 45 to about 900.

17. The composition of claim 14 comprising a metal salt of a hydrocarbyl substituted carboxylic acid.

18. The composition of claim 2 wherein the hydrocarbyl substituent of (5) has $\overline{M}_n$ ranging from about 500 to about 5000.

19. A method of heat treating metals comprising heating the metal to a temperature above its critical temperature and thereafter cooling the metal by immersion thereof into a quenching oil bath comprising the quenching oil composition of claim 1, wherein the medium substantially free of to free of sulphur is an aliphatic hydrocarbon solvent, and the aliphatic hydrocarbon solvent is present from at least about 50 wt % to about 100 wt % of the total amount of the medium;

wherein the detergent/dispersant additive comprises:

(1) a hydrocarbyl-substituted amine, (2) a hydrocarbyl-substituted hydroxy aromatic compound, (3) a Mannich reaction product, or (4) mixtures thereof.

* * * * *